United States Patent [19]

Rossi

[11] Patent Number: 4,516,333

[45] Date of Patent: May 14, 1985

[54] DEVICE FOR CONTROLLING THE POSITION OF PRODUCT CONTAINERS CARRYING PLATES OF A LYOPHILIZATION AND THE LIKE APPARATUS

[75] Inventor: Gianrico Rossi, Pavia, Italy

[73] Assignee: Edwards Alto Vuoto S.p.A., Milan, Italy

[21] Appl. No.: 496,406

[22] Filed: May 20, 1983

[30] Foreign Application Priority Data

May 25, 1982 [IT] Italy ..... 21983/82[U]

[51] Int. Cl.[3] ..... F26B 25/08

[52] U.S. Cl. ..... 34/92; 34/194; 34/5; 108/7; 312/313; 312/327

[58] Field of Search ..... 34/5, 92, 192, 194, 34/195; 108/1, 3, 7, 9; 312/136, 299, 313, 327

[56] References Cited

U.S. PATENT DOCUMENTS

| | | | |
|---|---|---|---|
| 1,816,705 | 7/1931 | Traylor et al. | 108/1 |
| 3,184,862 | 5/1965 | Frank | 34/194 |
| 4,067,265 | 1/1978 | Watson | 108/7 |

FOREIGN PATENT DOCUMENTS

| | | | |
|---|---|---|---|
| 2081080 | 2/1982 | United Kingdom | 108/7 |

*Primary Examiner*—Larry I. Schwartz

*Attorney, Agent, or Firm*—Collard, Roe & Galgano

[57] ABSTRACT

The device comprises a swivel joint coupling, connecting the top plate of the product carrying plate stack to the rod of the flacon sealing cylinder-piston assembly and adapted to allow a given inclination of the top plate and hence of all the other plates operatively associated therewith, an engagement member being provided acting laterally on at least one plate of the stack and adapted to interlock the plates on one side to forcibly tilt them as the rod is raised.

3 Claims, 4 Drawing Figures

DEVICE FOR CONTROLLING THE POSITION OF PRODUCT CONTAINERS CARRYING PLATES OF A LYOPHILIZATION AND THE LIKE APPARATUS

BACKGROUND OF THE INVENTION

This invention relates to a device useful in lyophilization systems of the type which utilizes product carrying plates horizontally supported in stacked relationship.

It is a known fact that after sterilization and/or scavenging, all of the flat surfaces located inside the lyophilization chamber, and more particularly the product carrying plates, are covered with many undesirable condensation drops or drops of scavenging fluid in consequence of their planar nature made necessary by the function they are to perform. On the other hand, sterilization is particularly directed to bring all the inner surfaces of the machine to a temperature corresponding to the steam pressure being used.

Since the heating medium is steam, it will be appreciated how any interference between steam and the surfaces to be heated can adversely affect a correct accomplishment of the sterilization operation. A main hindrance, between steam and the surfaces of the product carrier plates, is the formation of the cited condensate, which tends to resist the achievement of the sterilization temperature at those areas which are wetted by the steam condensate.

SUMMARY OF THE INVENTION

Thus, it is a primary object of this invention to remove the aforesaid drawbacks by providing for the product carrying plates to be drained before or during the sterilization and during or after the scavenging steps, so as to accomplish continued renewal of the steam contacting the surfaces, and thorough draining of the whole plate rack or stack.

A further object of the invention is to provide a device effective to accomplish said draining, quite simple construction-wise and simple in use, and so compact in size as not to affect the functionality of the lyophilization chamber and plates, it being above all constructed so as to utilize the standard flacon etc. vacuum sealing device which equips lyophilization chambers, i.e. the lowering and lifting system for the parallel interconnected plates, the uppermost whereof is hooked to said lowering/lifting system.

Another object is to increase the vacuum exposure surface of the product to be lyophilized.

These and other objects, which will be made more clearly understood thereinafter are achieved by a device for controlling the position of product containers carrying plates assembled in a plate rack structure and contained in a chamber of a lyophilization and the like apparatus, including an actuator unit, supporting means for said plate rack structure, said supporting means being vertically movable by said actuator unit to impart vertical movement to said plates and said plate rack structure, characterized in that said supporting means are in the form of a coupling allowing the plates of said plate rack structure to be tilted at least about one horizontal axis, and in that the device further comprises at least one engagement member arranged at a side region of said plate rack structure for controlling the relative vertical movement in at least one direction of said side region relative to the vertical movement of said plate rack structure, thereby to forcibly tilt the plates of said plate rack structure.

In one embodiment the engagement member comprises of preference a ledge extending from the top of the lyophilization chamber and so positioned as to abut against the side region of the first plate as the latter is raised by the mentioned rod.

According to a further embodiment of the invention, the engagement element comprises a cylinder-piston assembly having its piston rod arranged to act on a side region of the first plate, and accordingly, such as to do without the operation of the main cylinder-piston assembly.

BRIEF DESCRIPTION OF THE DRAWINGS

Further functional and constructional features of the inventive device will be apparent from the detailed description which follows, given with reference to the accompanying illustrative drawings, where.

DESCRIPTION OF THE PREFERRED EMBODIMENTS

Figure 1:
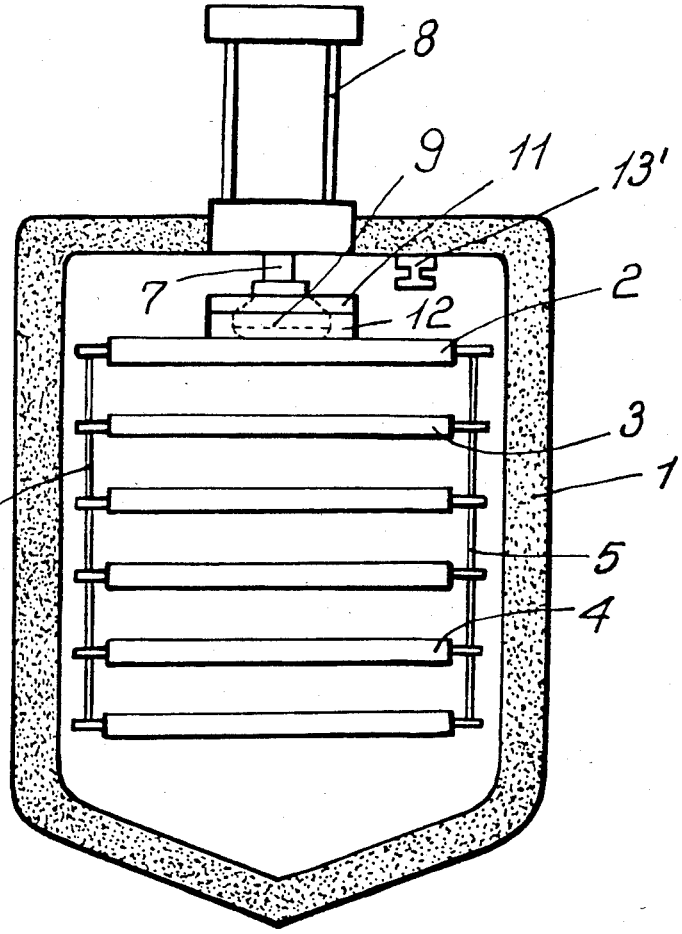
FIG. 1 is a fragmentary sectional view showing diagrammatically a lyophilization chamber, which can be sterilized by steam application and contains a stack or rack of product-carrying plates, said lyophylization chamber incorporating a plate tilting device according to this invention.
Figure 2:
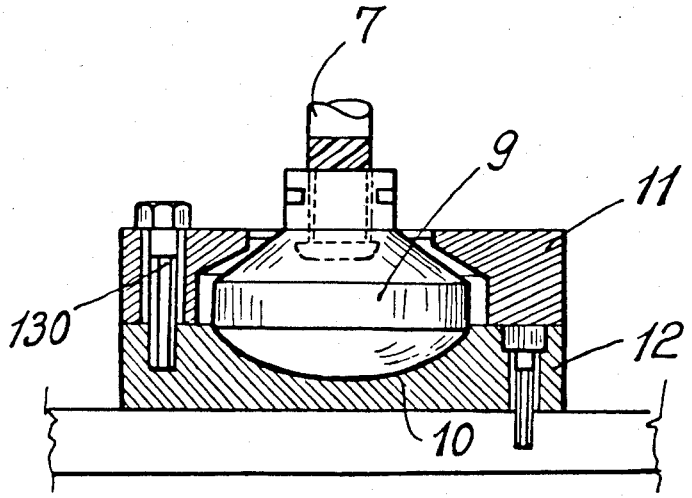
FIG. 2 is a diametrical section representation of a detail of this plate tilting device, namely an articulated joint coupling interposed between mechanism for closing the flacons or the like, of conventional design, and the first plate.

Making reference to the drawing figures, and particularly to FIGS. 1 and 2, the plate tilting device according to this invention is incorporated in a lyophilization chamber or autoclave 1, accommodating on its interior horizontal stacked plates 2,3,4, etc. which are interconnected, at preset spacings, by supporting links 5–6, etc.; on the plates, there are placed open flacons or the like, containing a product to be lyophilized. Normally, vacuum sealing of the flacons, upon completion of the lyophilization operation, is effected by lowering, and hence moving closer to one another, the plates toward each other through the rod 7 of a double-acting hydraulic cylinder-piston assembly 8 which is located at the top center area of the chamber 1 and connected to the first or top plate 2.

The lyophilization autoclave and the stacked plates structure and operation are not part of this invention and therefore only essential component parts and operation thereof are described in order to render the invention comprehensive. For the purpose of this invention it is sufficient to note that the rack of stacked plates 2,3,4 etc. behaves somewhat like an articulated quadrilateral or parallelogram in which vertical displacement of the links 5 and 6 relative to each other causes inclination or tilting of all the plates 2,3,4 etc. parallel to each other. Even though the operation of the rack of plates 2, 3, 4 etc. is not of interest for the comprehension of this invention, mention is made of the fact that the coupling of the plates 2,3,4, etc. onto the links 5 and 6 is such as to allow that the plates are approached to each other or spaced apart within limits. This may be obtained by rendering the links 5 and 6 flexible, i.e. made of chains or cables or of telescoping elements. The links could be also made of rigid rods, which are passed through holes (not shown) provided in the plates 2,3,4 etc. the rods having controllable stop formations (not shown) on which the plates selectively rest. In operation, after sterilization, open flacons or jars with the product to be lyophilized contained therein are placed on the plates 2,3,4 etc. in arrayed order, the autoclave being provided for the purpose with a door or port (not shown) allowing access to the shelf-like plates. On the downwardly facing lower surfaces of each plate 2,3,4 etc. plugs or caps (not shown) for the flacons or jars are removably held in vertical alignment with the respective flacon or jar. Upon closure of the autoclave, it is subjected to lyophilization vacuum and temperature conditions for a preestablished time period.

After the lyophilization has been effected the cylinder-piston assembly 8 is actuated to move downwardly the rack of plates 2,3,4 etc. until the lowermost plate reaches a stop formation on the bottom of the autoclave so that the rack of plates is compressed between the assembly 8 and the bottom stop formation, the plates approaching each other until the plugs or caps held on the lower surface of each plate sealingly closes the respective flacon or jar. The assembly 8 is then caused to lift the rack of plates, the autoclave is opened and the sealed flacons or jars removed. Afterwards the scavenging and steam sterilization treatment is carried out through supply ducts (not shown) to render the autoclave suitable for a new operating cycle. Thus far the description of that operation which is not part of this invention.

The plate tilting device according to the invention makes use of said flacon sealing cylinder-piston assembly. The device comprises a swivel joint 9 the pin or male member of which having a semispherical head portion arranged to oscillate within a suitable bearing seat 10 formed between two opposed plates 11–12; the latter are interconnected by studs 130 (FIG. 2). The male member of the swivel joint 9 is made rigid with the rod 7, and the lowermost plate 12 is connected to the first or top product carrying plate 2.

Figure 3:
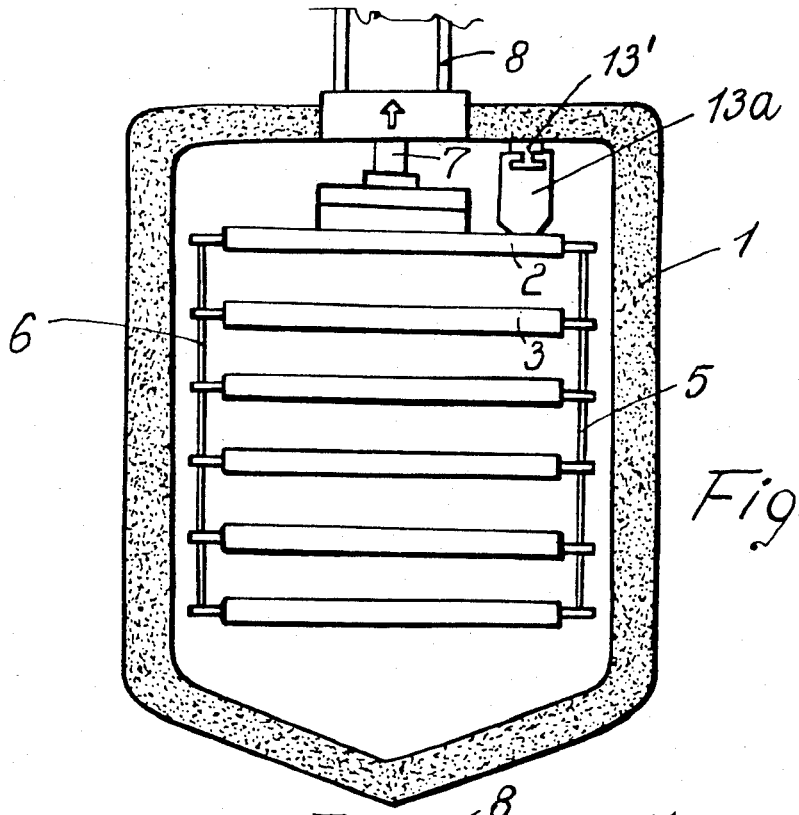
FIG. 3 shows, again diagrammatically the same chamber as shown in FIG. 1 with its plate set tilted, according to a first embodiment of the invention.

On the chamber 1 interior, and laterally to the sealing assembly 8, there is located a fixed element 13', e.g. a rigid or only partly yielding pin or block which may be either a single piece construction (FIG. 1) or made up of two mutually engageable pieces **13'–13*a* (FIG. 3) and is adapted to provide a hooking stop system abutting against the upper surface of the upperplate 2 at a side region thereof, thereby upon rising of the actuator assembly 8 it is effective to prevent rising of the whole rack of plates on one side; said side abutment engagement arrangement enables, through further raising of the rod 7 of the sealing assembly 8**, the whole set of product carrier plates to be tilted.

Figure 4:
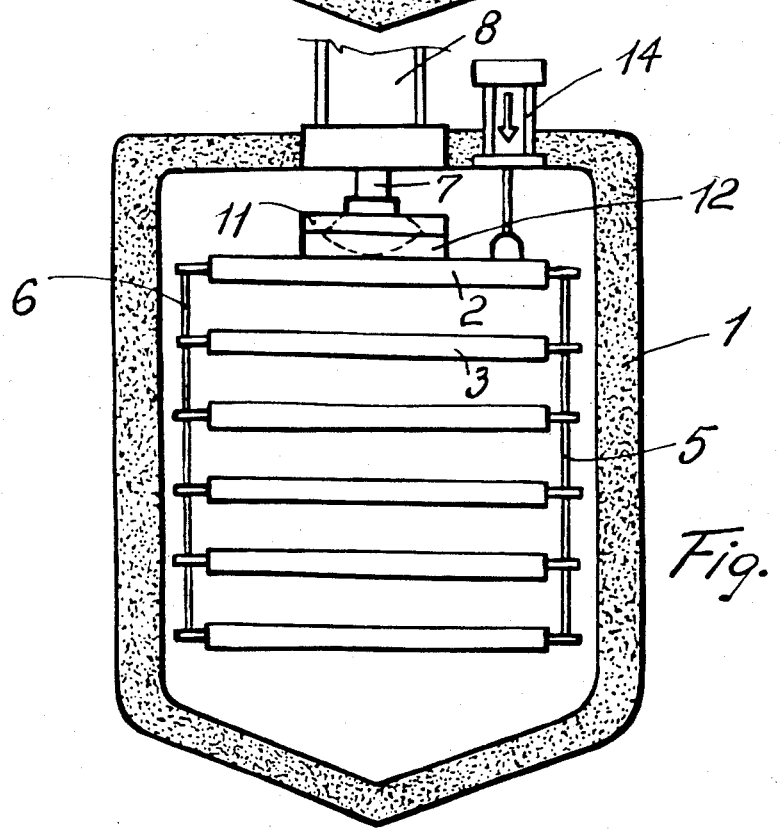
FIG. 4 shows the same chamber as shown in FIG. 3 but with a differently embodied tilting device, also according to this invention.

Also according to this invention, instead of a fixed biasing pin **13'–13*a*, the inclination of the product carrier plate set may be accomplished by means of a separate cylinder-piston device, as indicated at 14 in FIG. 4, which may be either hydraulically or air operated and the rod of which produces a desired inclination by acting in the proximity of one side of the product carrier plate perimeter. Moreover, instead of a cylinder-piston 14, a weight arrangement may be advantageously used the weights whereof, when acting through an axially slidable stem similar to that of the piston 14 onto the side region of the first plate 2, are effective to move the entire plate set an inclined position, even when the actuator assembly 8** is in a fixed position.

With the tilting devices described hereinabove, it becomes possible to achieve thorough draining of the plate rack upon flushing and, owing to the absence of condensation, a perfectly uniform temperature during the sterilization step.

A further important advantage brought about by the inventive tilting device is that, when the plates of the plate rack are inclined with the flacons or jars thereon, the upper surface of the incoherent product contained therein has the tendency to remain horizontal and therefore assumes an inclined plane or flute-end shape with respect to the axis of the flacon or jar. If the inclination is maintained during the product freezing step, the product can be frozen in the flacons such that the free surface of the product takes a flute-end (inclined plane) configuration which by increasing the evaporation surface area, allows shorter lyophilization times, with attendant significant savings in power and increased output per unit time. For the purpose seat formations (not shown) are provided on the plates to prevent sliding of the containers such as jars or flacons, when the plates are inclined.

Of course, in practicing the invention, additional constructionally and functionally equivalent modifications and variations may be introduced without departing from the scope of the invention. Thus for example, the engagement member 13, instead of engaging the plate 2 of the upper plate rack structure, could engage one of the links 5 or 6 if the same were in the form of rigid rods or telescoping elements and could even act on the lowermost plate or link upwardly.

I claim:

1. A device for controlling and tilting the Position of product containers carrying plates assembled in a plate rack structure and contained in a chamber of a lyophilization and the like apparatus, including a vertical axis pressure fluid operated cylinder-piston assembly arranged centrally at the top of said chamber, supporting links for said plate rack structure which permit adjustment of the spacing between the plates in said plate rack structure, said supporting links being vertically movable by said pressure fluid operated cylinder-piston assembly to impart vertical movement to said plates and said plate rack structure, said device comprising a swivel joint connecting the top plate of said plate rack structure to the rod of said cylinder-piston assembly so as to allow the plates of said rack structure to be tilted with respect to the horizontal plane, at least one engagement member provided laterally to said swivel joint at the top of the chamber and acting on at least the top plate of said rack structure to interlock all said plates on one side thereof to forcibly tilt them by a relative movement between said cylinder-piston rod and said engagement member.

2. A device according to claim 1, in which said engagement member comprises a pin projecting from the inner top portion of the lyophilization chamber and being positioned such as to form a stop acting in contact relationship with a side region of the top product containers carrying plate as the latter is lifted by the rod of said cylinder-piston assembly.

3. A device according to claim 1, in which said engagement member comprises an independent cylinder-piston assembly located at the top of the chamber and having a rod directed against the side region of the top plate of said plate stack and accordingly operative to tilt said rack as said rod is lowered.

* * * * *